US006431754B1

(12) United States Patent
Savicki, Sr.

(10) Patent No.: US 6,431,754 B1
(45) Date of Patent: Aug. 13, 2002

(54) END STOP FOR RECLOSABLE FASTENER AND METHOD OF INSTALLATION THEREON

(75) Inventor: Alan F. Savicki, Sr., Naperville, IL (US)

(73) Assignee: The Glad Products Company, Oakland, CA (US)

( * ) Notice: Subject to any disclaimer, the term of this patent is extended or adjusted under 35 U.S.C. 154(b) by 121 days.

(21) Appl. No.: 09/616,955

(22) Filed: Jul. 14, 2000

(51) Int. Cl.[7] ..... B32B 31/20; A44B 19/36

(52) U.S. Cl. ..... 383/64; 24/387; 24/436; 156/73.1

(58) Field of Search ..... 156/73.1–73.5, 156/66, 69, 70, 272.2, 379.6, 434; 24/385, 387, 415, 458, 461, 467, 437, 545, 585.1, 585.12; 383/61, 64, 65, 68, 69, 203; 493/962

(56) References Cited

U.S. PATENT DOCUMENTS

| | | | |
|---|---|---|---|
| 4,817,252 | A | 4/1989 | Kusayama |
| 4,842,799 | A | 6/1989 | Kusayama |
| 5,067,208 | A | 11/1991 | Herrington et al. |
| 5,283,932 | A | 2/1994 | Richardson |
| 5,390,396 | A | 2/1995 | Hirota |
| 5,448,807 | A | 9/1995 | Herrington |
| 5,664,299 | A | 9/1997 | Porchia |
| 5,669,715 | A | 9/1997 | Dobreski et al. |
| 5,722,128 | A | 3/1998 | Toney |
| 5,769,772 | A | 6/1998 | Wiley |
| 5,775,812 | A | 7/1998 | Phillips et al. |
| 5,788,378 | A | 8/1998 | Thomas |
| 5,809,621 | A | 9/1998 | McCree et al. |
| 5,836,056 | A | 11/1998 | Porchia et al. |
| 5,871,281 | A | 2/1999 | Stolmeler et al. |
| 5,947,603 | A | 9/1999 | Tilman |

*Primary Examiner*—Richard Crispino
*Assistant Examiner*—Sing P. Chan
(74) *Attorney, Agent, or Firm*—Thomas C. Feix

(57) ABSTRACT

The present invention is directed to an end stop for a thermoplastic bag having a reclosable fastener at the open top end of the bag. The end stop is configured to facilitate snap fit insertion onto the fastener strips. The end stop further include inwardly directed tab and shoulder structure that engage the reclosable fastener and prevent the end stop from being inadvertently pulled off in a transverse direction in order to hold the end stop in place prior to being bonded to the bag. In the case of the line production of thermoplastic bags wherein a continuous web of plastic material is moved from one station to the next, the invention allows for the positioning of the end stop onto the reclosable fastener at a first station and the bonding of the end stop to the bag at a second station.

13 Claims, 6 Drawing Sheets

END STOP FOR RECLOSABLE FASTENER AND METHOD OF INSTALLATION THEREON

FIELD OF THE INVENTION

The present invention relates to improvements in closure devices for plastic storage bags, and more particularly, to an end stop for use on a plastic reclosable fastener and a method of installation thereon.

BACKGROUND OF THE INVENTION

The use of closure devices for fastening storage containers, including plastic bags, is generally known. Furthermore, the manufacture of closure devices made of plastic materials is generally known to those skilled the in the art, as demonstrated by the numerous patents in this area.

A particularly well-known use for closure devices is in connection with flexible storage containers, such as plastic bags. In some instances, the closure device and the associated container are formed from thermoplastic materials, and the closure device and the sidewalls of the container are integrally formed by extrusion as a single piece.

Alternatively, the closure device and sidewall of the container may be formed as separate pieces and then connected by heat sealing or any other suitable connecting process. In either event, such closure devices are particularly useful in providing closure means for retaining matter within the bag.

Conventional closure devices typically utilize mating fastening strips or closure elements, which are used to selectively seal the bag. In addition, sliders may be provided for use in opening and closing the fastening strips. Such reclosable bags equipped with sliders are known in the art as "slider bags." The slider may include a separator which extends at least partially between the fastening strips. When the slider is moved in the opening direction, the separator divides or deoccludes the fastening strips and opens the bag. When the slider is moved in the closing direction, the slider closes or occludes the fastening strips.

It is well known in the art to provide one or both ends of the reclosable fastener of a slider bag with an end stop to prevent movement of the slider past the ends of the bag. The end stop may be formed from the material of the fastening strips such that they protrude transversely from the fastener a distance adequate to engage the slider and prevent movement of the slider passed the respective ends of the bag as is known from U.S. Pat. No. 5,950,285 to Porchia et al. With this arrangement the size of the end stops is limited by the amount of material in the ends of the fastener.

Another prior art end stop arrangement is disclosed in U.S. Pat. No. 5,161,286 to Herrington et al. In this patent the end stops are located at the opposite ends of the reclosable fastener and each end stops is fashioned as a pair of clamp members connected together by a flexible strap which extends over the top of the zipper and which are also secured together by a plastic rivet that pierces the film material of the bag below the reclosable fastener. A drawback with this approach is the potential for leakage that may occur anytime the bag is pierced.

U.S. Pat. No. 5,448,807 to Herrington discloses another prior art end stop arrangement in which the end stop is formed as a separate plastic clip that is fused with the ends of the fastening strips of a zipper type reclosable fastener during manufacture of the bag. In accordance with the manufacturing method aspect of the invention, this patent document teaches to position the clip at opposite ends of the reclosable fastener, the clip comprising a strap member that is wrapped over the top of the zipper, and then sealing in place along with the profile elements of the fastening strips to form a fused mass. This patent document further teaches to use an insertion device to hold the clips in place while they are being sealed to the zipper. In order to hold the clips in place by themselves, the clips may be provided with an integral pin that penetrates the zipper film. Thus, in the line production of thermoplastic bags, the multiple steps of positioning the end stop on the bag, holding the end stop in place prior to fusing, and fusing the end stop to the bag are done in a lengthy sequence at a single station on the line. The lengthy sequence of steps at a single station in a line production results in slow line speed and low throughput.

It would be desirable to position and secure end stops on a reclosable fastener of a thermoplastic bag in the line production of thermoplastic bags in a manner in which increased line speed and greater throughput are achieved.

SUMMARY OF THE INVENTION

The present invention is directed to an end stop for a thermoplastic bag having a reclosable fastener at the open top end of the bag. The reclosable fastener comprises a pair of interlocking fastening strips. The end stop is configured to facilitate snap fit insertion onto the fastener strips and includes a top portion and a pair of depending side portions that straddle the fastener. The side portions further include inwardly directed tab and shoulder structure that engage the reclosable fastener and prevent the end stop from being inadvertently pulled off in a transverse direction in order to hold the end stop in place prior to being bonded to the bag. The bonding step is preferably accomplished by ultrasonic welding.

In the case of the line production of thermoplastic bags wherein a continuous web of plastic material is moved from one station to the next, the invention allows for the positioning of the end stop onto the reclosable fastener at a first station and the bonding of the end stop to the bag at a second station. The positioning and bonding steps may be performed simultaneously since the tab and shoulder structure hold the end stop in place on the reclosable fastener as the web of plastic material is moved from the first station to the second station. The ability to perform the simultaneous sequence of steps described above advantageously provides for increased line speed production and throughput.

The bags may include a slider for use in opening and closing the reclosable fastener. The slider is slidably disposed on the interlocking fastening strips for facilitating the occlusion and deocclusion of the fastening strips when moved towards first and second ends of the fastening strips. The first and second ends of the fastening strips are secured together and the end stop is provided to the first, closing end of the fastening strips. The end stop may be provided with quick release latching structure engagable with cooperating latch-receiving structure provided to the mating or opening end of the slider to secure the slider when it is moved into engagement with the end stop at the closing end of the bag. In accordance with an alternate embodiment, a second end stop may be provided at the other end of the bag.

Methods and apparatus which incorporate the features described above and which are effective to function as described above constitute further, specific objects of the invention. Other objects and advantages of the invention will become apparent upon reading the following description and upon reference to the drawings.

BRIEF DESCRIPTION OF THE DRAWINGS

For a more complete understanding of this invention reference should now be had to the embodiments illustrated in greater detail in the accompanying drawings and described below by ways of examples of the invention. In the drawings.

DESCRIPTION OF THE PREFERRED EMBODIMENTS

Figure 1:
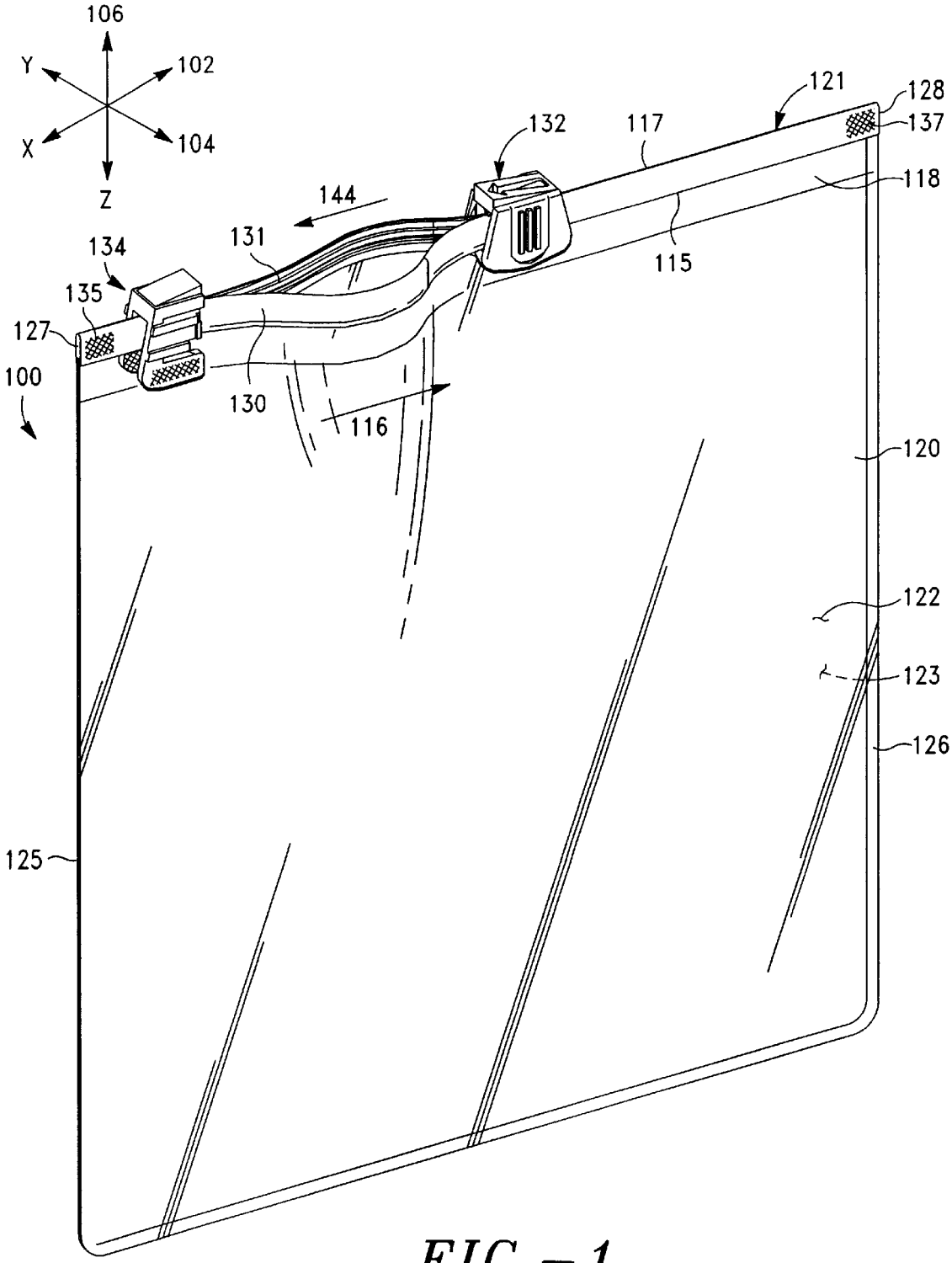
FIG. 1 is a perspective view of a container in the form of a plastic bag having a slider and an end stop provided with means for quick release latching engagement of the slider in accordance with one embodiment of the present invention.

A container constructed in accordance with a preferred embodiment of the present invention is generally designated by reference numeral 100 in FIG. 1. The container 100 is in the form of a plastic food bag 120 having a reclosable fastener device 121 at the open top of the bag 120. The bag 120 includes a first sidewall 122 and a second sidewall 123 joined at seams 125, 126 to define a compartment accessible through the open top but sealable by means of the closure device 121. The closure device 121 includes first and second fastening strips 130, 131 and a slider 132. The fastening strips 130, 131 are adapted to be interlocked between a first end 127 and a second end 128. The fastening strips 130, 131 are secured together at the first and second ends 127, 128 to form end seals. As shown in the figures, the first and second ends 127, 128 include melted portions 135, 137, in which the fastening strips 130, 131 are melted together by heat sealing, ultrasonic sealing or other operation to form the end seals. In other embodiments, the first and second ends 127 and 128 may be secured together by plastic clamps, or by other means. The closure device 121 further includes an end stop 134 disposed proximate the first end 127.

The fastening strips 130, 131, slider 132 and end stop 134 have a longitudinal X-axis 102, a transverse Y-axis 104 and a vertical Z-axis 106. The transverse Y axis 104, the longitudinal X axis 102 and the vertical Z axis 106 are mutually perpendicular to one another and define a three axis coordinate system. The fastening strips 130, 131 each have a bottom edge 115 and a top edge 117. The closure device 121 may include a tape portion 118 that extends downward a distance from the bottom edge 115 of the fastening strips 130, 131 for attachment to the respective first and second sidewalls 122, 123. Alternately, tape portion may be omitted and the sidewalls 122, 123 may be attached directly to the respective first and second fastening strips 130, 131.

The slider 132 straddles the fastening strips 130, 131 and is mounted so that the slider 132 is restrained from being inadvertently pulled off of the fastening strips 130, 131 along the vertical Z axis 106 but is free to slide back and forth along the longitudinal X axis 102. The slider 132 engages the fastening strips 130, 131 so that when the slider moves in the occlusion direction 114, the fastening strips 130, 131 interlock and the bag 120 is sealed, and when the slider 132 moves in a deocclusion direction 116, the fastening strips 130, 131 separate and the bag is open.

Figure 2:
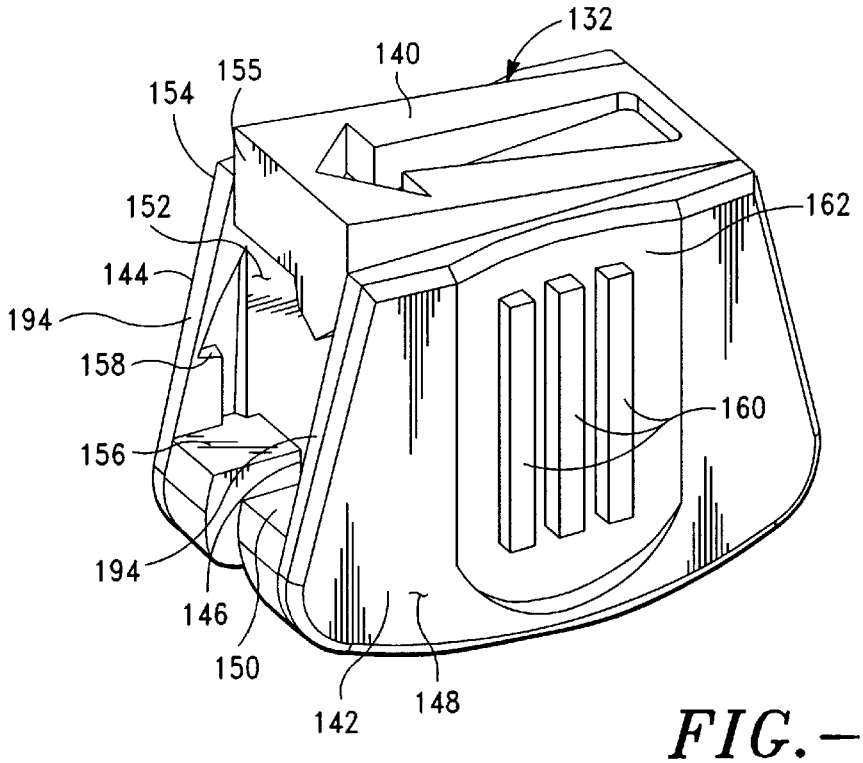
FIG. 2 is an enlarged perspective view of the slider of FIG. 1.
Figure 4:
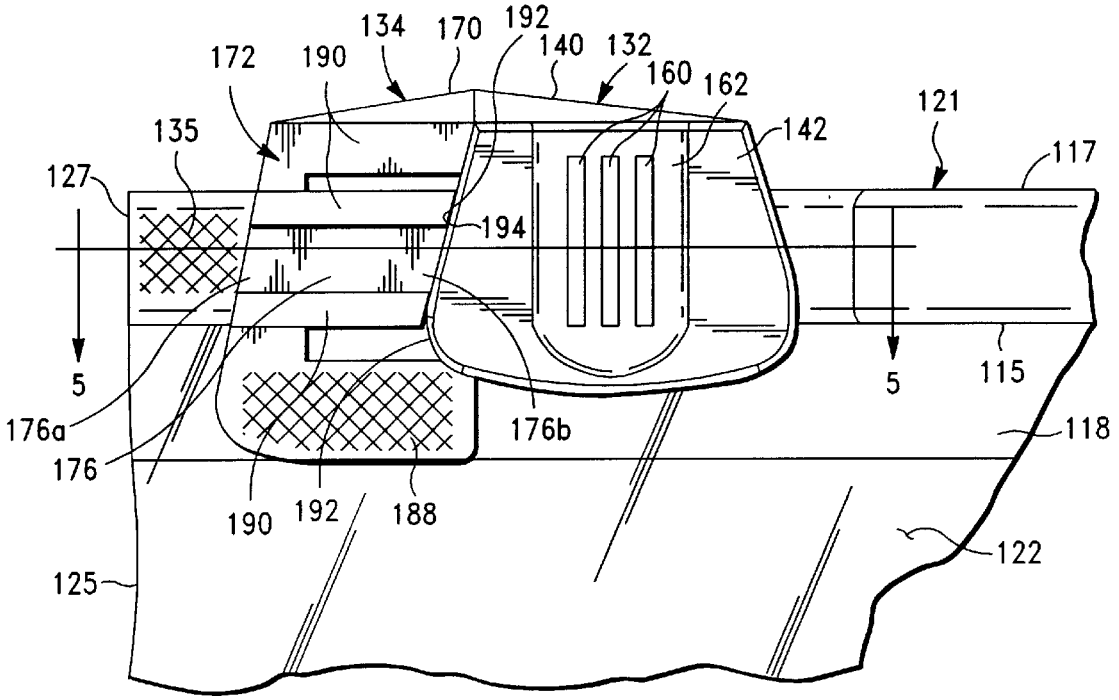
FIG. 4 is an enlarged fragmentary side elevation view of the container of FIG. 1.
Figure 5:
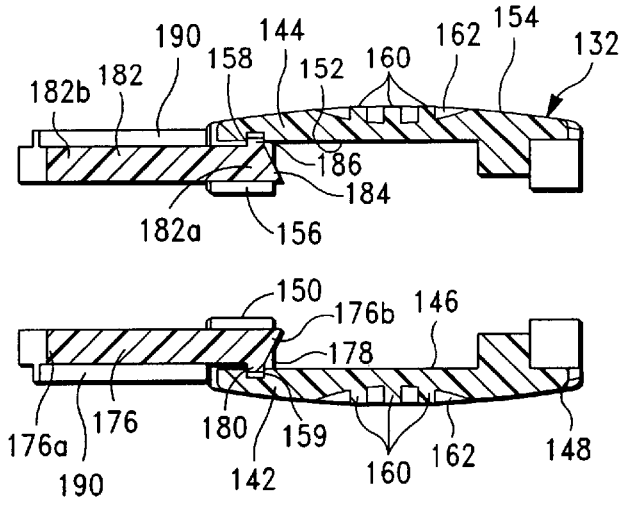
FIG. 5 is a partial cross-sectional view through the end stop and slider taken along the line and in the direction of arrows 5—5 of FIG. 4 (note the reclosable fastener has been omitted for clarity)

FIG. 2 is a perspective view looking into the opening end of the slider 132. The slider 132 includes a top portion 140, a first side portion 142 and a second side portion 144. The first side portion 142 has an inner side wall 146 and an outer side wall 148, and an inwardly directed bottom tab 150. Similarly, the second side portion 144 has an inner side wall 152 and an outer side wall 154, and an inwardly directed bottom tab 156. As best seen in FIGS. 4 and 5, the outer side walls 148 and 154 are bowed outward.

The first and second side portions 142, 144 straddle the respective first and second fastening strips 130, 131 and the inwardly directed tabs 150, 156 mate with the respective bottom edges 115 of the fastening strips 130, 131. The slider 132 is prevented from being accidentally pulled off of the reclosable fastener 121 by the engagement between the upper surfaces of the inwardly directed bottom tabs 150, 156 and the bottom edge 115 of the respective first and second fastening strips 130, 131.

As best seen in FIG. 2, inner sidewall 152 of the second side portion 144 is provided with a recess 158, the purpose of which will be described in greater detail below. Although not visible in FIG. 2, the inner sidewall 146 of the first side portion 142 is similarly provided with a recess 159. In accordance with an alternate embodiment, only one of the first and second side walls is provided with a recess. Each of the outer sidewalls 142 and 154 is provided with upraised ridges 160 which provide gripping areas for the user's fingers when moving the slider 132 back and forth along the reclosable fastener 121. As best seen in FIGS. 2, 4 and 5, the ridges 160 sit within a shallow well 162 provided to the respective outer sidewalls 148, 154 of the first and second side portions 142, 144 so as to maintain the bowed outward contour of the outer sidewalls 148, 154.

Figure 3:
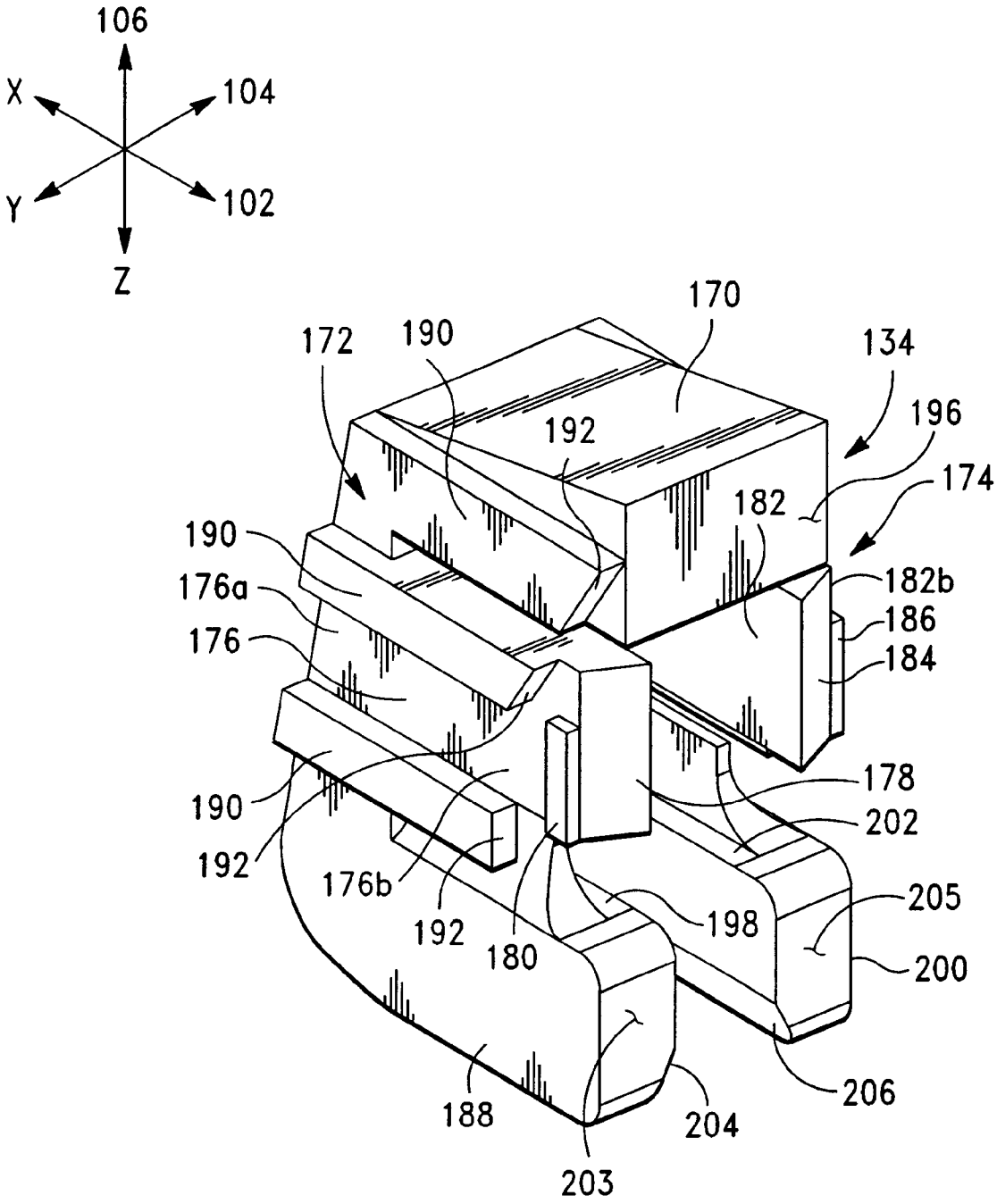
FIG. 3 is an enlarged perspective view of the end stop of FIG. 1.

Referring to FIGS. 3 and 4, the end stop 134 includes a top portion 170, a first side portion 172 and a second side portion 174. The first side portion 172 includes a latch member 176 having a base end **176*a* connected to the first side portion 172 and a free end 176*b* that extends in the longitudinal x-axis 102. The free end 176*b* includes an end face 178 that is tapered inwardly in the direction of the longitudinal x-axis 102. The free end 176*b* further includes a ridge member or projection 180 that extends outwardly in the direction of the transverse y-axis 104. In similar fashion, the second side portion 174 includes a latch member 182 having a base end 182*a* connected to the second side portion 174 and a free end 182*b* that extends in the longitudinal x-axis 102. The free end 182*b* includes an end face 184 that is tapered inwardly in the direction of the longitudinal x-axis 102. The free end 182*b* further includes a ridge member or projection 186 that extends outwardly in the direction of the transverse y-axis 104**.

Figure 8:
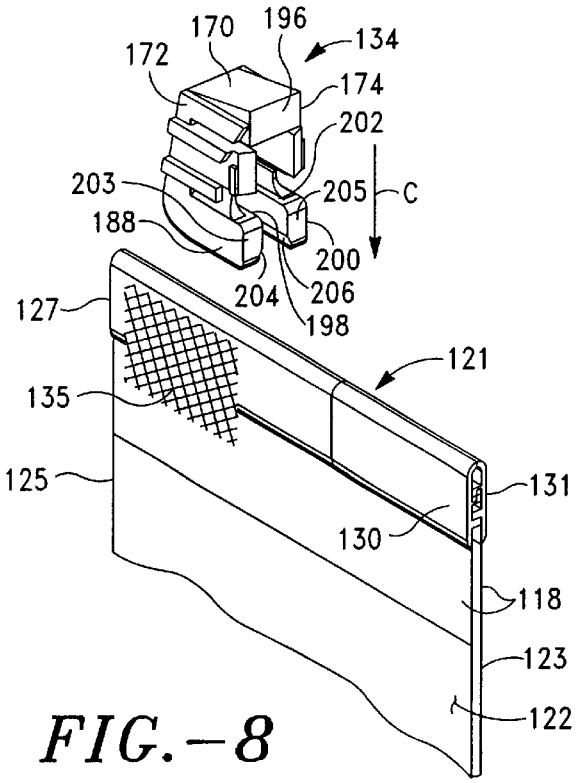
FIGS. 8 is a perspective view which illustrates the step of positioning the end stop onto the reclosable fastener of a thermoplastic bag.
Figure 9:
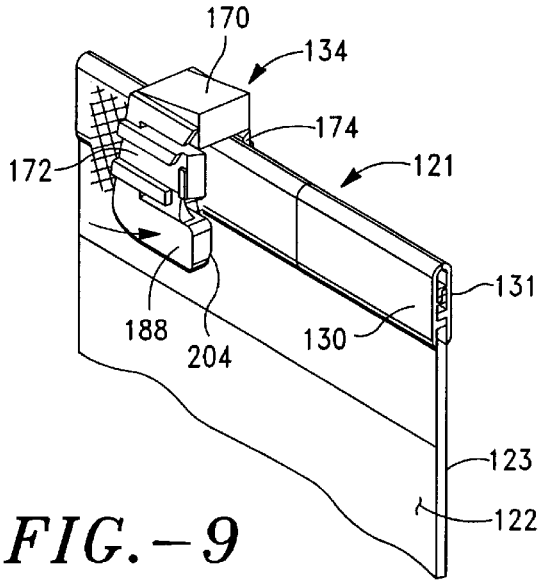
FIG. 9 is a perspective view similar to FIG. 8 wherein the end stop is shown in position on the reclosable fastener.
Figure 10:
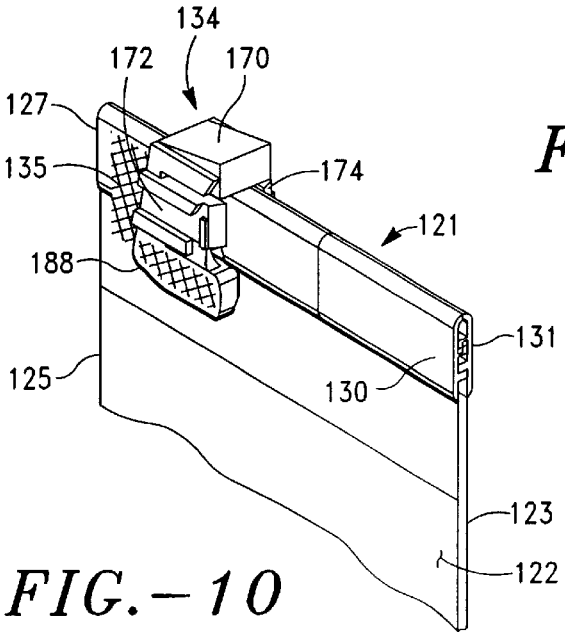
FIG. 10 is a perspective view which illustrates the step of bonding the end stop to the sides of the thermoplastic bag.

The end stop 134 straddles the fastening strips 130, 131 at the first end 127 of the bag. End stop side portion 172 includes a bottom portion 188 having an inwardly projecting tab 198 adapted to engage against the bottom edge 115 of fastening strip 130. Similarly, end stop side portion 174 includes a bottom portion 200 having an inwardly projecting tab 202 adapted to engage against the bottom edge 115 of fastening strip 131. The lower inside corners of each tab 198, 202 are provided with upwardly and inwardly tapered surfaces 204 and 206, respectively. The tapered surfaces 204, 206 facilitate snap fit insertion of the end stop 134 onto the reclosable fastener 121. The end stop 134 is secured in straddling position over the reclosable fastener 121 by heat sealing, ultrasonic sealing or other operation to form seals between the bottom portions 188, 200 and the respective adjacent sides of the bag 120. The sequence of steps in positioning and securing the end stop 134 to the fastener 121 is illustrated in FIGS. 8–10.

As best seen in FIG. 4, the slider 132 and the end stop 132 are conformingly contoured in outer appearance so as to provide an aesthetic blend of the two parts and so 15 that they interfacially fit together when the slider 132 is positioned against the end stop 134 at the closing end 127 of the bag 120. The respective top portions 140 and 170 of the slider 132 and end stop 134 slope upward to form a common peak at the point of interfacial engagement between the respective mutually facing end faces 155 and 196 of the slider 132 and end stop 134. Each of the end stop side portions 172 and 174 further include upstanding longitudinally oriented ribs 190 having end faces 192 adapted to conform with and abut against the respective leading edges 194 of the first and second side portions 142, 144 of the slider 132 when the slider is moved into to the fully closed position on the bag 120.

Figure 6:
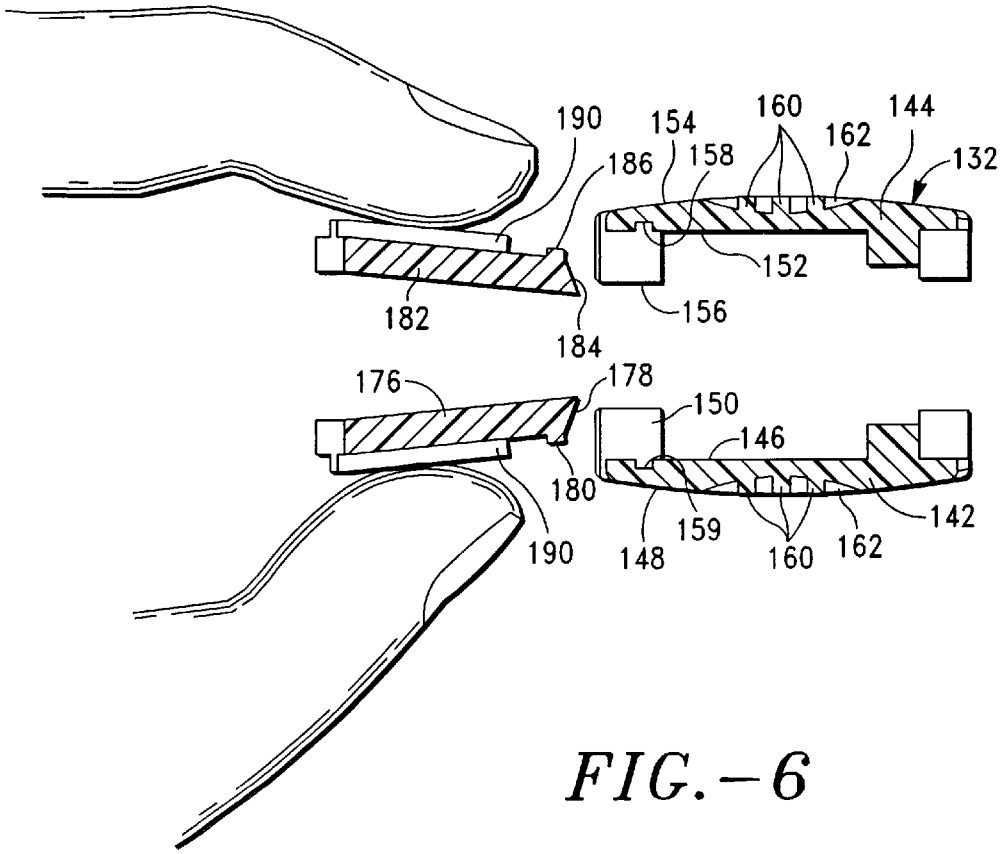
FIG. 6 is a partial cross-sectional view similar to FIG. 5 showing the slider disengaged from the end stop.

In accordance with the present invention there is provided means for the quick release latching engagement of the slider 132 to the end stop 134. Referring now to FIGS. 5 and 6, a positive latching of the slider 132 to the end stop 143 is effectuated by the cooperating receiving engagement of the outward projections 180, 186 on the latch members 176, 184 of the end stop 134 within the corresponding recesses 158, 159 of the slider 132. The inward tapered faces 178, 184 on the respective free ends of latch members 176, 182 help guide the interfacial latching engagement between the slider 132 and end stop 134. The latch members 176, 182 of the end stop 134 are inwardly bendable or deflectable in the direction of the transverse y-axis 104 as shown in FIG. 6. The inward deflection of the latch members 176, 182 moves the respective outward projections 180, 186 out of engagement with the recesses 158, 159 thereby permitting the slider 132 to be moved in the opening direction of the bag. While, a dual latch member arrangement has been shown and described, it is understood that a single latch member arrangement may also be used with equally good results. In other words, the end stop 134 described herein may have only one side portion equipped with a deflectable latch member that is receivingly engagable within a recess provided to an inner sidewall of the slider 132.

Figure 7:
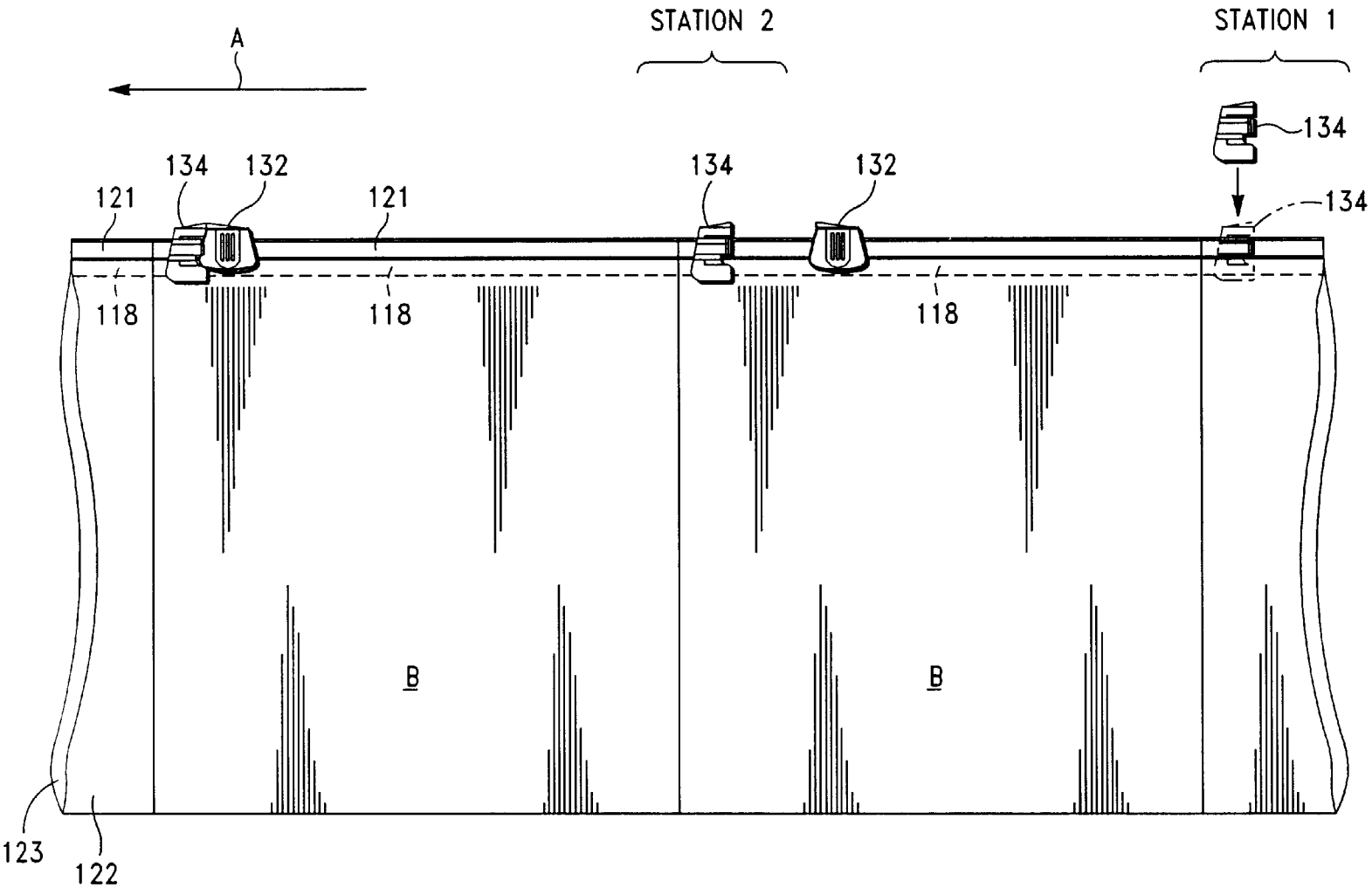
FIG. 7 is an elevational view of a line production assembly of thermoplastic bags manufactured in accordance with the present invention.

FIG. 7 illustrates a line production of a series of thermoplastic bags B in which end stops 134 embodying the present invention are positioned onto the reclosable fastener 121 of the bags B at a first station (Station 1) and then bonded to the sides of the bags B at a second station (Station 2). The bags B are advanced from Station 1 to Station 2 to as indicated by directional arrow A. The slider 132 may be positioned onto the reclosable fastener 121 either upstream or down stream of Station 1 or Station 2.

Referring now to FIGS. 8–10, there is shown in greater detail the steps of positioning and bonding the end stop 134 onto the reclosable fastener 121. End face 196 of the end stop top portion 170 and end faces 203, 205 of the respective end stop side portions 172, 174 are straight edges and are all aligned in a common plane to facilitate bowl feeding of the end stops for positioning (inserting) onto the reclosable fastener 121. The interior surfaces of side portions 172, 174 of the end stop 134 are configured for snap fit insertion onto the reclosable fastener 121. As noted above in connection with the description of FIG. 3, the shoulder structure as defined by the inwardly projecting tabs 198, 200 of the respective side portions 172, 174 function to restrain transverse movement of the end stop 134 relative to the reclosable fastener 121. Stated in another way, the tabs 198, 200 prevent the end stop from being in advertently pulled off of the reclosable fastener 121 prior to welding. The gap between the vertical faces of the inwardly projecting tabs 198, 200 is dimensioned for a close tolerance snug fit engagement over the fastening strips 130, 131 of the reclosable fastener 121. The respective inner bottom surfaces 204 and 206 of the tabs 198, 200 are inwardly and upwardly tapered to facilitate the downward snap fit insertion of the end stop 134 onto the reclosable fastener 121 as indicated by directional arrow C in FIG. 8. The bottom portions 188, 190 are configured to provide a sufficient surface area to permit ultrasonic welding to the respective side panels 122, 123 of the bag. The resultant bond created at Station 2 (FIG. 7) that is formed between the bottom portion 188 and the adjacent side panel 122 is indicated by the cross-hatching shown in FIGS. 1, 4, and 10.

Although several interlocking fastening strip embodiments have been specifically described and illustrated herein, it will be readily appreciated by those skilled in the art that other kinds, types, or forms of fastening strips can alternatively be used without departing from the scope or spirit of the present invention.

The interlocking fastening strips may be manufactured by extrusion through a die and may be formed from any suitable thermoplastic material including, for example, polyethylene, polypropylene, nylon, or the like, or from a combination thereof. Thus, resins or mixtures of resins such as high-density polyethylene, medium-density polyethylene, and low-density polyethylene may be employed to prepare the interlocking fastening strips.

When the fastening strips are used in a sealable bag, the fastening strips and the films that form the body of the bag may be conveniently manufactured from heat sealable material. In this way, the bag may be economically formed by using an aforementioned thermoplastic material and by heat sealing the fastening strips to the bag. For example, the bag may be made from a mixture of high pressure, low-density polyethylene and linear, low-density polyethylene.

The fastening strips may be manufactured by extrusion or other known methods. For example, the closure device may be manufactured as individual fastening strips for later attachment to the bag or may be manufactured integrally with the bag. In addition, the fastening strips may be manufactured with or without flange portions on one or both of the fastening strips depending upon the intended use of the fastening strips or expected additional manufacturing operations.

Generally, the fastening strips can be manufactured in a variety of forms to suit the intended use. The fastening strips may be integrally formed on the opposing sidewalls of the container or bag, or connected to the container by the use of any of several known methods. For example, a thermoelectric device may be applied to a film in contact with the flange portion of the fastening strips or the base portion of fastening strips having no flange portion, to cause a transfer of heat through the film to produce melting at the interface of the film and a flange portion or base portion of the fastening strips. Suitable thermoelectric devices include heated rotary discs, traveling heater bands, resistance-heated slide wires, and the like. The connection between the film and the fastening strips may also be established by the use of hot melt adhesives, hot jets of air to the interface, ultrasonic heating, or other known methods. The bonding of the fastening strips to the film stock may be carried out either before or after the film is U-folded to form the bag. In any event, such bonding may be done prior to side sealing the bag at the edges by conventional thermal cutting. In addition, the first and second fastening strips may be positioned on opposite sides of the film. Such an embodiment would be suited for wrapping an object or a collection of objects such as wires. The first and second fastening strips should usually be positioned on the film in a generally parallel relationship with respect to each other, although this will depend on the intended use.

Both the slider and/or end stop may be multiple parts and snapped together. In addition, both the slider and/or may be made from multiple parts and fused or welded together. The slider and/or end stop may also be a one-piece construction. They can be colored, opaque, translucent or transparent as desired. Both pieces may be injection molded or made by any other method. The slider and/or end stop may be molded from any suitable plastic material, such as high-density polyethylene, polypropylene, nylon, acetal, toughened acetal, polyketone, polybutylene terrephthalate, polycarbonate or ABS (acrylonitrile-butadiene-styrene)

From the foregoing it will be understood that modifications and variations may be effectuated to the disclosed structures—particularly in light of the foregoing teachings—without departing from the scope or spirit of the present invention. As such, no limitation with respect to the specific embodiments described and illustrated herein is intended or should be inferred. On the contrary, it is intended to cover all alternatives, modifications and equivalents as may be included within the spirit and scope of the invention as defined by the appended claims.

What is claimed is:

1. A method of installing an end stop onto a reclosable fastener of a thermoplastic bag which includes front and rear side panels joined together along three sides to define an open mouth, wherein the reclosable fastener extends along the mouth of the bag and a slider straddles the fastener, the fastener comprising first and second interlocking fastening strips attached to respective ones of said front and rear side panels and arranged to be interlocked over a predetermined longitudinal x-axis between a first end and second end of the bag, the fastening strips being fused together at the first and second ends, the slider adapted to occlude the fastening strips when moved toward the first end and deocclude the fastening strips when moved toward the second end, the method comprising:

positioning a generally inverted u-shaped end stop onto said first end of the fastening strips, said end stop including a top portion and first and second side portions depending from said top portion, said first and second side portions adapted to be positioned adjacent said first and second interlocking fastening strips, each of said first and second side portions having a lower inwardly directed tab portion with a shoulder adapted to engage a lowermost portion of the respective adjacent fastening strip to restrain transverse movement of the end stop once positioned onto the fastening strips; and bonding the corresponding tab portion of each side portions to the adjacent front and rear side panels of the bag.

2. The invention of claim 1 wherein the bonding is performed by ultrasonic means.

3. The invention of claim 1 wherein each tab portion includes an inwardly and upwardly directed tapered surface to facilitate snap-fit positioning of the end stop onto the fastening strips.

4. The invention of claim 1 wherein the end stop includes an end having outermost surfaces aligned along a common plane to facilitate bowl fed positioning of the end stop onto the reclosable fastener.

5. The invention of claim 1 wherein the positioning step and the bonding step are performed simultaneously on adjacent bags in a series of bags.

6. A method of installing an end stop onto a thermoplastic bag having a reclosable fastener extending along the mouth of the bag, the fastener comprising first and second interlocking fastening strips attached to respective front and rear side panels of the bag and arranged to be interlocked over a predetermined longitudinal x-axis between a first end and second end of the bag, the fastening strips being fused together at the first and second ends the method comprising:

positioning a generally inverted u-shaped end stop onto one of said first and second ends of the fastening strips, said end stop including a top portion and first and second side portions depending from said top portion, said first and second side portions adapted to be positioned adjacent said first and second interlocking fastening strips, each of said first and second side portions having a lower inwardly directed tab portion with a shoulder adapted to engage a lowermost portion of the respective adjacent fastening strip to restrain transverse movement of the end stop once positioned onto the fastening strips; and bonding the corresponding tab portion of each side portions to the adjacent front and rear side panels of the bag.

7. The invention of claim 6 wherein the bonding is performed by ultrasonic means.

8. The invention of claim 6 wherein each tab portion includes an inwardly and upwardly directed tapered surface to facilitate snap-fit positioning of the end stop onto the fastening strips.

9. The invention of claim 6 wherein the end stop includes an end having outermost surfaces aligned along a common plane to facilitate bowl fed positioning of the end stop onto the reclosable fastener.

10. The invention of claim 6 wherein the positioning step and the bonding step are performed simultaneously on adjacent bags in a series of bags.

11. In a thermoplastic bag having front and rear side panels and a reclosable fastener extending along the mouth of the bag, the fastener comprising first and second interlocking fastening strips attached to respective ones of said front and rear side panels and arranged to be interlocked over a predetermined longitudinal x-axis between a first end and second end of the bag, the fastening strips being fused together at the first and second ends, wherein the improvement comprises:

an end stop located adjacent at least one of said first and second ends of said fastening strips;

said end stop being of a generally inverted u-shaped configuration and including a top portion and first and second side portions depending from said top portion, said first and second side portions adapted to be positioned adjacent said first and second interlocking fastening strips, each of said first and second side portions having a lower inwardly directed tab portion with a shoulder adapted to engage a lowermost portion of the respective adjacent fastening strip to restrain transverse movement of the end stop once positioned onto the secured end of the fastening strips; and each of said first and second side portions including a bottom portion extending a distance downwardly from said reclosable fastener and bonded to respective front and rear panels of said bag.

12. The invention of claim 11 wherein each tab portion includes an inwardly and upwardly directed tapered surface to facilitate snap-fit positioning of the end stop onto the fastening strips.

13. The invention of claim 11 wherein the end stop includes an end having outermost surfaces aligned along a common plane to facilitate bowl fed positioning of the end stop onto the reclosable fastener.

* * * * *